US009774154B2

(12) United States Patent
St. Laurent et al.

(10) Patent No.: US 9,774,154 B2
(45) Date of Patent: Sep. 26, 2017

(54) WALL SOCKET PLATES WITH AT LEAST A THIRD RECEPTACLE AND SYSTEMS AND METHODS THEREOF

(71) Applicant: SNAPRAYS, LLC, Vineyard, UT (US)

(72) Inventors: Daniel St. Laurent, Webster, MA (US); Daniel Diotte, Pickering (CA); William Olszta, Webster, MA (US)

(73) Assignee: SnapRays, LLC, Vineyard, UT (US)

( * ) Notice: Subject to any disclaimer, the term of this patent is extended or adjusted under 35 U.S.C. 154(b) by 0 days.

(21) Appl. No.: 15/280,491

(22) Filed: Sep. 29, 2016

(65) Prior Publication Data

US 2017/0018897 A1 Jan. 19, 2017

Related U.S. Application Data

(63) Continuation-in-part of application No. 13/821,366, filed as application No. PCT/US2011/050524 on Sep. 6, 2011, now Pat. No. 9,482,426.

(60) Provisional application No. 61/380,561, filed on Sep. 7, 2010.

(51) Int. Cl.

| | |
|---|---|
| ***H05B 37/00*** | (2006.01) |
| ***H01R 25/00*** | (2006.01) |
| ***H01R 13/447*** | (2006.01) |
| ***H01R 13/717*** | (2006.01) |

(52) U.S. Cl.
CPC ..... *H01R 25/006* (2013.01); *H01R 13/447* (2013.01); *H01R 13/717* (2013.01)

(58) Field of Classification Search
None
See application file for complete search history.

(56) References Cited

U.S. PATENT DOCUMENTS

| | | | |
|---|---|---|---|
| 2,015,698 | A | 10/1935 | Tiffany |
| 2,227,549 | A | 1/1941 | McNeill |
| 2,385,620 | A | 9/1945 | Fleckenstein |
| 2,428,167 | A | 9/1947 | Linton |
| 2,515,820 | A | 7/1950 | Clark |
| 2,575,820 | A | 11/1951 | Linton |
| 2,580,056 | A | 12/1951 | Wheeler, Jr. |
| 2,749,381 | A | 6/1956 | Farish |
| 2,880,285 | A | 3/1959 | Robison et al. |
| 2,908,743 | A | 10/1959 | Premoshis |
| 2,934,590 | A | 4/1960 | Thompson et al. |
| 3,120,414 | A | 2/1964 | Farish, Jr. |

(Continued)

FOREIGN PATENT DOCUMENTS

| | | |
|---|---|---|
| EP | 2211210 | 3/2007 |
| NO | 2007122141 | 11/2007 |
| NO | 2012006812 | 1/2012 |

OTHER PUBLICATIONS

Plate Pals Wallplate Thermometers, http://www.platepals.com/ last visited Apr. 21, 2017, 2006.

*Primary Examiner* — Cassandra Cox

(57) ABSTRACT

The invention relates generally to a wall socket plate for replacing existing wall sockets in one simple installation step. The wall socket plate obtains electric current from socket terminal screws to power at least a third receptacle by connecting metal tabs on the back side of the wall socket plate to socket terminals, and transferring electric current from the socket terminals to additional receptacles through conductive material, in accordance with the invention described herein.

9 Claims, 4 Drawing Sheets

(56) References Cited

U.S. PATENT DOCUMENTS

| | | | |
|---|---|---|---|
| 3,307,030 | A | 2/1967 | Francisco |
| D212,760 | S | 11/1968 | Bordner |
| 3,522,595 | A | 8/1970 | White |
| 3,588,489 | A | 6/1971 | Gaines |
| 3,680,237 | A | 8/1972 | Finnerty, Sr. |
| 3,739,226 | A | 6/1973 | Seiter et al. |
| 3,859,454 | A | 1/1975 | Mann |
| 3,879,101 | A | 4/1975 | McKissic |
| 3,895,225 | A | 7/1975 | Prior |
| 4,000,405 | A | 12/1976 | Horwinski |
| 4,038,582 | A | 7/1977 | Horwinski |
| 4,117,258 | A | 9/1978 | Shanker |
| 4,255,780 | A | 3/1981 | Sakellaris |
| 4,282,591 | A | 8/1981 | Andreuccetti |
| 4,514,789 | A | 4/1985 | Jester |
| 4,534,486 | A | 8/1985 | Eidson |
| 4,611,264 | A | 9/1986 | Bradley |
| 4,616,285 | A | 10/1986 | Sackett |
| 4,617,613 | A | 10/1986 | Rice |
| 4,755,913 | A | 7/1988 | Sleveland |
| 4,774,641 | A | 9/1988 | Rice |
| D330,267 | S | 10/1992 | Hendrix |
| 5,248,919 | A | 9/1993 | Hanna |
| 5,290,175 | A | 3/1994 | Robinson |
| 5,384,428 | A | 1/1995 | Luu |
| 5,406,439 | A | 4/1995 | Crane et al. |
| 5,473,517 | A | 12/1995 | Blackman |
| D366,339 | S | 1/1996 | Waller |
| 5,481,442 | A | 1/1996 | Dickie et al. |
| 5,485,356 | A | 1/1996 | Nguyen |
| 5,622,424 | A | 4/1997 | Brady |
| 5,670,776 | A | 9/1997 | Rothbaum |
| 5,683,166 | A | 11/1997 | Lutzker |
| D395,314 | S | 6/1998 | Oikawa |
| D399,825 | S | 10/1998 | Heung et al. |
| 5,816,682 | A | 10/1998 | Marischen |
| D401,566 | S | 11/1998 | Gesmondi |
| D407,072 | S | 3/1999 | Gaule |
| 5,914,826 | A | 6/1999 | Smallwood |
| 6,000,807 | A | 12/1999 | Moreland |
| 6,010,228 | A | 1/2000 | Blackman |
| 6,023,021 | A | 2/2000 | Matthews et al. |
| 6,087,588 | A | 7/2000 | Soules |
| 6,089,893 | A | 7/2000 | Yu et al. |
| D429,829 | S | 8/2000 | Doran |
| D464,865 | S | 10/2002 | Luu |
| D473,528 | S | 4/2003 | Wengrower |
| 6,547,411 | B1 | 4/2003 | Dornbusch |
| 6,648,496 | B1 | 11/2003 | Elghoroury et al. |
| 6,709,126 | B1 | 3/2004 | Leen |
| 6,765,149 | B1 | 7/2004 | Ku |
| 6,805,469 | B1 | 10/2004 | Barton |
| D500,743 | S | 1/2005 | Savicki, Jr. et al. |
| 6,974,910 | B2 | 12/2005 | Rohmer |
| 7,011,422 | B2 | 3/2006 | Robertson et al. |
| 7,036,948 | B1 | 5/2006 | Wyatt |
| D542,627 | S | 5/2007 | Rohmer et al. |
| 7,247,793 | B2 | 7/2007 | Hinkson |
| 7,270,436 | B2 | 9/2007 | Jasper |
| 7,318,653 | B2 | 1/2008 | Chien |
| D567,633 | S | 4/2008 | Anderson |
| 7,360,912 | B1 | 4/2008 | Savicki, Jr. |
| D576,566 | S | 9/2008 | Wu et al. |
| D577,985 | S | 10/2008 | Kidman |
| 7,506,990 | B2 | 3/2009 | Glazner |
| 7,547,131 | B2 | 6/2009 | Faunce et. al |
| 7,576,285 | B1 | 8/2009 | Savicki, Jr. |
| D606,029 | S | 12/2009 | Chou |
| 7,745,750 | B2 | 6/2010 | Hewson et al. |
| 7,821,160 | B1 | 10/2010 | Roosli et al. |
| 7,946,871 | B1 | 5/2011 | Yu et al. |
| 7,972,152 | B1 * | 7/2011 | Wu ..... H01R 13/60 439/131 |
| 8,003,886 | B1 | 8/2011 | Rintz |
| D650,112 | S | 12/2011 | Bryant |
| 8,148,637 | B2 | 4/2012 | Davidson |
| 8,304,652 | B2 | 11/2012 | McBain |
| 8,393,747 | B2 | 3/2013 | Kevelos et al. |
| 8,511,866 | B1 | 8/2013 | Mendez |
| 8,564,279 | B2 | 10/2013 | Johnson et al. |
| 8,668,347 | B2 | 3/2014 | Ebeling |
| 8,697,991 | B2 | 4/2014 | Davidson |
| 8,797,723 | B2 * | 8/2014 | Hilton ..... H02G 3/123 315/159 |
| D719,699 | S | 12/2014 | Bryant |
| 8,912,442 | B2 * | 12/2014 | Smith ..... H02G 3/14 174/66 |
| 9,482,426 | B2 | 11/2016 | Diotte |
| 2001/0046130 | A1 | 11/2001 | Cunningham et al. |
| 2003/0013503 | A1 | 1/2003 | Menard et al. |
| 2003/0124022 | A1 | 7/2003 | Georges et al. |
| 2004/0247300 | A1 | 12/2004 | He et al. |
| 2004/0251118 | A1 * | 12/2004 | Chang ..... H01R 9/2416 200/200 |
| 2005/0264383 | A1 | 12/2005 | Zhang |
| 2006/0065510 | A1 | 3/2006 | Kiko et al. |
| 2006/0072302 | A1 | 4/2006 | Chien |
| 2006/0161270 | A1 | 7/2006 | Luskin et al. |
| 2006/0262462 | A1 | 11/2006 | Barton |
| 2007/0206375 | A1 * | 9/2007 | Piepgras ..... A43B 1/0027 362/147 |
| 2008/0073117 | A1 | 3/2008 | Misener |
| 2008/0233780 | A1 | 9/2008 | Waters et al. |
| 2008/0266121 | A1 | 10/2008 | Ellul |
| 2009/0153438 | A1 | 6/2009 | Miller et al. |
| 2009/0225480 | A1 | 9/2009 | Baxter |
| 2009/0284385 | A1 | 11/2009 | Tang et al. |
| 2011/0056720 | A1 | 3/2011 | Davidson |
| 2011/0210833 | A1 | 9/2011 | McNeely et al. |
| 2012/0008307 | A1 | 1/2012 | Delany |
| 2012/0156937 | A1 | 6/2012 | Almouli |
| 2012/0182172 | A1 | 7/2012 | Sorensen |
| 2012/0215470 | A1 | 8/2012 | Maguire |
| 2012/0316808 | A1 | 12/2012 | Frader-Thompson et al. |
| 2013/0063848 | A1 | 3/2013 | Thorpe et al. |
| 2013/0221868 | A1 | 8/2013 | Diotte et al. |
| 2015/0371534 | A1 | 12/2015 | Dimberg et al. |

* cited by examiner

WALL SOCKET PLATES WITH AT LEAST A THIRD RECEPTACLE AND SYSTEMS AND METHODS THEREOF

CROSS-REFERENCE TO RELATED APPLICATIONS

This application claims priority to U.S. provisional application No. 61/380,561 filed Sep. 7, 2010, PCT application No. PCT/US2011/050524 filed Sep. 6, 2011, and U.S. utility application Ser. No. 13/821,366, filed Mar. 7, 2013 and incorporates the entire contents thereof herein by reference.

FIELD OF THE INVENTION

The invention relates generally to an easy to install wall socket plate that obtains power from wall socket terminals, to power at least a third receptacle embedded in the wall socket plate.

BACKGROUND INFORMATION

The invention relates generally to a wall socket plate that can be installed easily to replace existing wall socket plates with at least a third receptacle. The wall socket plate in accordance with the present invention has metal tabs and conductive material on the back of the plate to supply electric current to at least a third receptacle embedded in the plate. More particularly, the metal tabs conduct electric current from socket terminal screws for powering an additional four receptacles in a wall socket plate.

Various wall socket plates with additional features have been devised and constructed to enhance or add to the standard wall socket plate. Examples of enhanced wall socket plates include U.S. Pat. No. 7,318,653 which covers a multiple function wall cover plate with a front cover and a bottom base, prongs to supply electricity from an existing receptacle, a light between the front cover and the back base and a fragrance refill means. The multiple function wall cover plate uses one prong set to plug into an existing wall socket receptacle to power one or more new receptacles on the multiple function wall cover plate and to power the added features of the multiple function wall cover plate. Unlike the present invention, the '653 patent requires the use of existing receptacles to power the multiple function wall cover plate and requires a bulky system to provide new receptacles in order to maintain the original number of receptacles in the wall socket.

Other U.S. references found include U.S. Pat. Nos. 2,015,698; 3,307,030; 3,895,225; 4,774,641; 5,683,166; 6,089,893; 6,709,126; 6,648,496. None of the prior references discovered describe or show the ability to power at least a third receptacle without blocking one socket receptacle or using the prongs of one socket receptacle to power a power strip or other multiple receptacle object. The ability to use electric current in wall socket terminals to power at least a third receptacle is a unique discovery in accordance with the present invention.

SUMMARY

A wall socket plate in accordance with the present invention provides an easy method for replacing standard wall socket plates with at least a third receptacle. The wall socket plate utilizes a simple technique where metal tabs are used to conduct power in the existing wall socket terminal screws to convert and provide electric current to power at least a third receptacle in a wall socket plate. In accordance with at least one of the methods and devices described herein, the wall socket plate and all of its receptacles remains powered once the plate is screwed into the existing wall socket.

There are many uses for a wall socket plate that can easily be screwed into a wall socket with additional receptacles, as further described herein.

BRIEF DESCRIPTION OF DRAWINGS

These objectives and features of the invention shall now be described in relationship to the following figures, which are an integral part of the specifications and are incorporated herein.

DETAILED DESCRIPTION OF THE PREFERRED EMBODIMENT

In the following detailed description of the invention, reference is made to the accompanying drawings, which form a part hereof, and which is shown by way of illustration of specific exemplary embodiments in which the invention may be practiced. These embodiments are described in sufficient detail to enable those skilled in the art to practice the invention, but other embodiments may be utilized and logical and other changes may be made without departing from the scope of the present invention. The following detailed description is, therefore, not to be taken in a limiting sense.

In the following description, numerous specific details are set forth to provide a thorough understanding of the invention. However, it is understood that the invention may be practiced without these specific details. In other instances, well-known steps, tools and techniques and socket types known to one of ordinary skill in the art have not been shown in detail in order not to obscure the invention. Referring to the figures, it is possible to see the various major elements constituting the methods and systems of the present invention.

Figure 1:
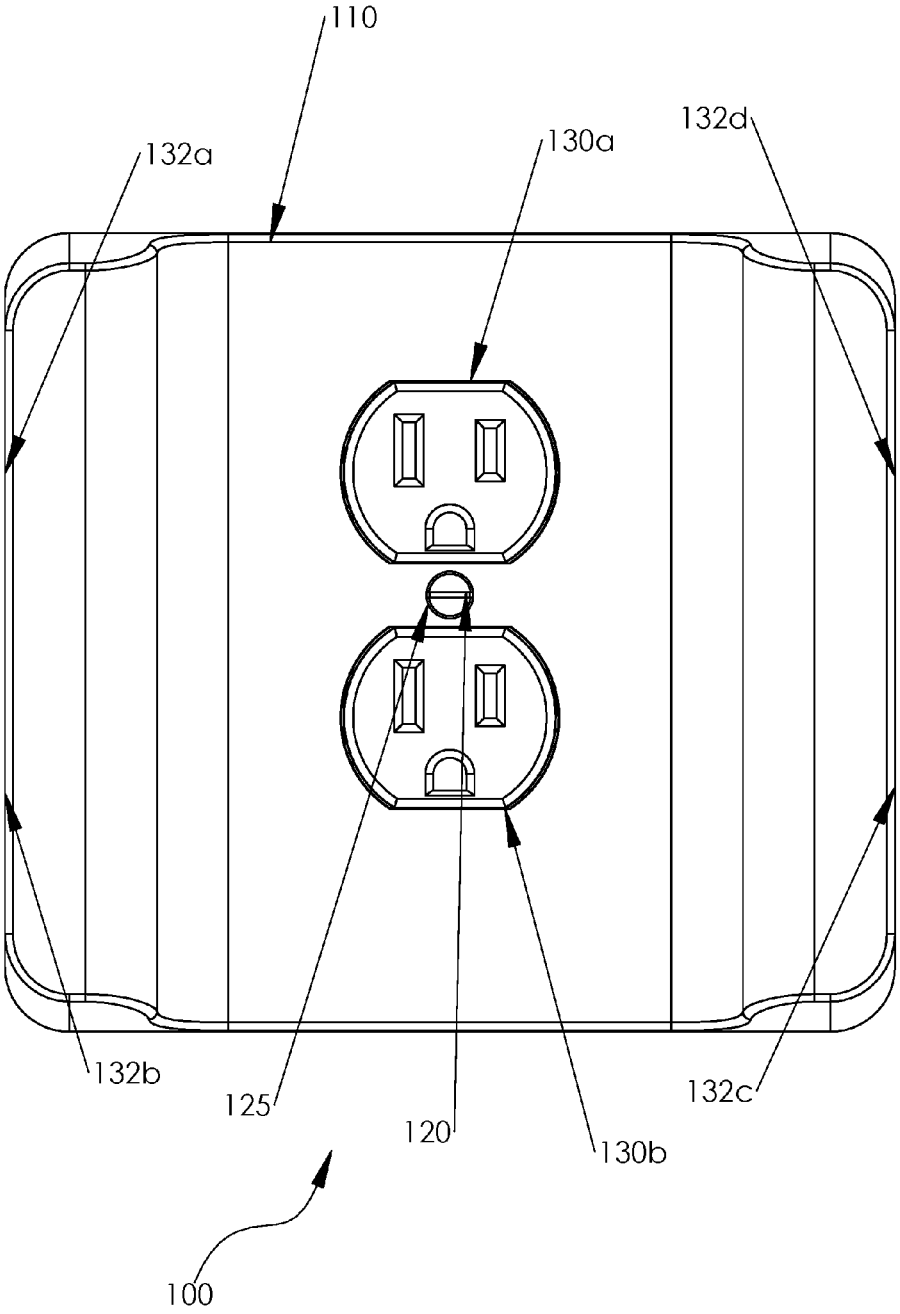
FIG. 1 is a front view of the wall socket plate in accordance with an embodiment of the present invention.

As shown in the drawings wherein like numerals represent like parts throughout the several views, there is generally disclosed in FIG. 1 a front view of a wall socket plate 100, showing a plate 110, a first receptacle 130*a*, a second receptacle 130*b*, as found in standard wall socket plates, and a third, fourth, fifth and sixth wall receptacle 132*a*, 132*b*, 132*c* and 132*d* respectfully, and a hole for a screw 120 for attaching the wall socket plate 100 to a wall with a screw 125. In accordance with the embodiment shown, the wall socket plate 100 can easily replace a standard socket plate by simply removing the socket plate and screwing in the wall socket plate 100, and all six receptacles will have power, thereby allowing a user to have more receptacles to use without having to block one receptacle with, for instance, a power strip, in order to add receptacles to the wall socket.

Figure 2:
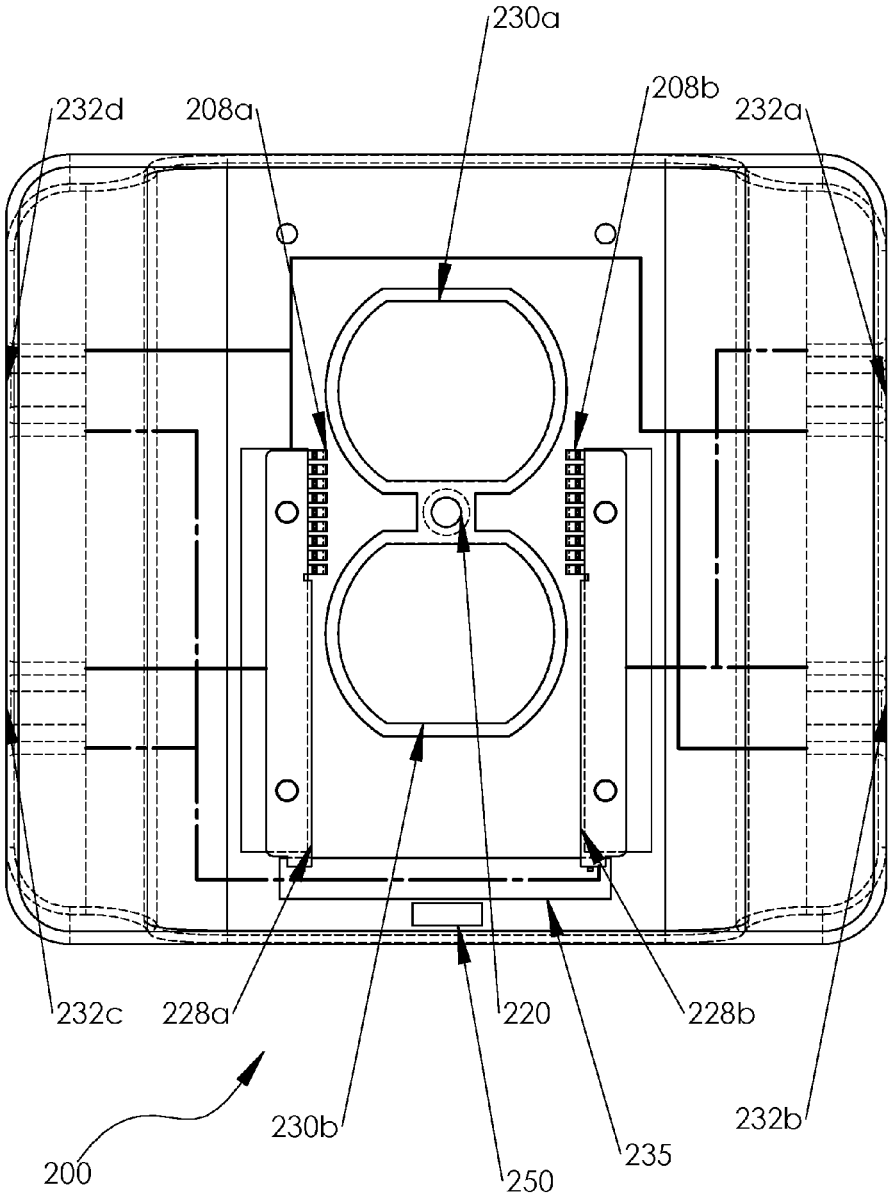
FIG. 2 is a back view of a wall socket plate in accordance with an embodiment of the present invention.

FIG. 2 depicts a back view of the wall socket plate 200 in accordance with the first embodiment of the present invention. The back perspective view shows metal tabs 208*a* and 208*b* for attaching the wall socket plate around existing terminal screws in the wall socket (shown in FIG. 3) for transporting electric current from the terminal screws through the conductive material 228*a* and 228*b* leading the electric current to receptacles 232*a*, 232*b*, 232*c* and 232*d* in accordance with the present invention. The metal tabs 208*a* and 208*b* are designed in this embodiment to easily clip around the terminal screws in the wall socket, for easy and safe installation by a user. A hole for a screw 220 is shown in FIG. 2 centered in the plate 200 for attaching the plate 200 to the wall socket with a screw. A first plate receptacle 230*a* and a second plate receptacle 230*b* are provided so that a user can use the original receptacles in the wall socket without covering or using the wall socket receptacles having to add new receptacles on the wall socket plate 200 to power the new receptacles 232*a*, 232*b*, 232*c* and 232*d*.

As a further description of the first embodiment in accordance with the present invention, the metal tabs 208*a* and 208*b* are provided to obtain power surrounding the screws in the wall socket, as further shown in FIG. 2. The diameter of the wall socket plate with the metal tabs 208*a* and 208*b* is preferably between 0.01 and 0.07 mm for ease of use by a consumer to replace an already existing wall plate. Non-conductive surrounding material may be used as a safety precaution to surround the metal tabs 208*a* and 208*b*.

In accordance with the back perspective view of the embodiment shown in FIG. 2, a circuit board 235 may be provided in the wall socket plate to convert power obtained from the wall socket screws to power a light embedded in the socket plate. In accordance with this embodiment, the light may be any kind of light suitable for a wall socket plate, including but not limited too, E.L elements, light emitting diodes, incandescent bulbs, neon lights, fluorescent tubes, black lights, gas filled bulbs, halogen lights, or any other light capable of fitting into or connecting to the wall socket plate 200. In addition, the light may be located anywhere on the back or front of the wall socket plate 200 in addition to on or surrounding receptacle 232*a*, 232*b*, 232*c*, and/or 232*d*, in accordance with the embodiment shown. In accordance with this embodiment a light on receptacle 232*c* lighting up the wall socket plate 200 is provided for ease of use of a consumer to readily identify the wall socket plate 250 in the dark.

Figure 3A:
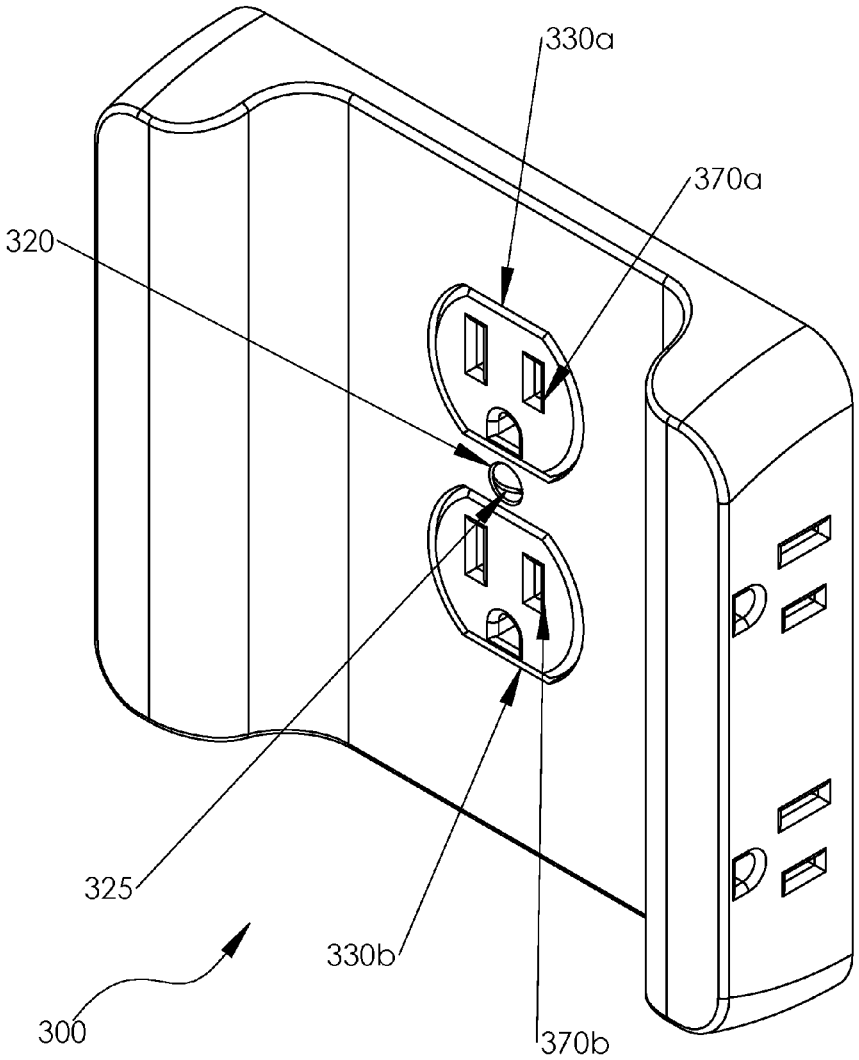
FIG. 3A and FIG. 3B are side perspective view of a wall socket plate and a wall socket showing the metal tabs and the socket terminal screws for supplying electric current to power additional receptacles in the wall socket plate in accordance with an embodiment of the present invention.
Figure 3B:
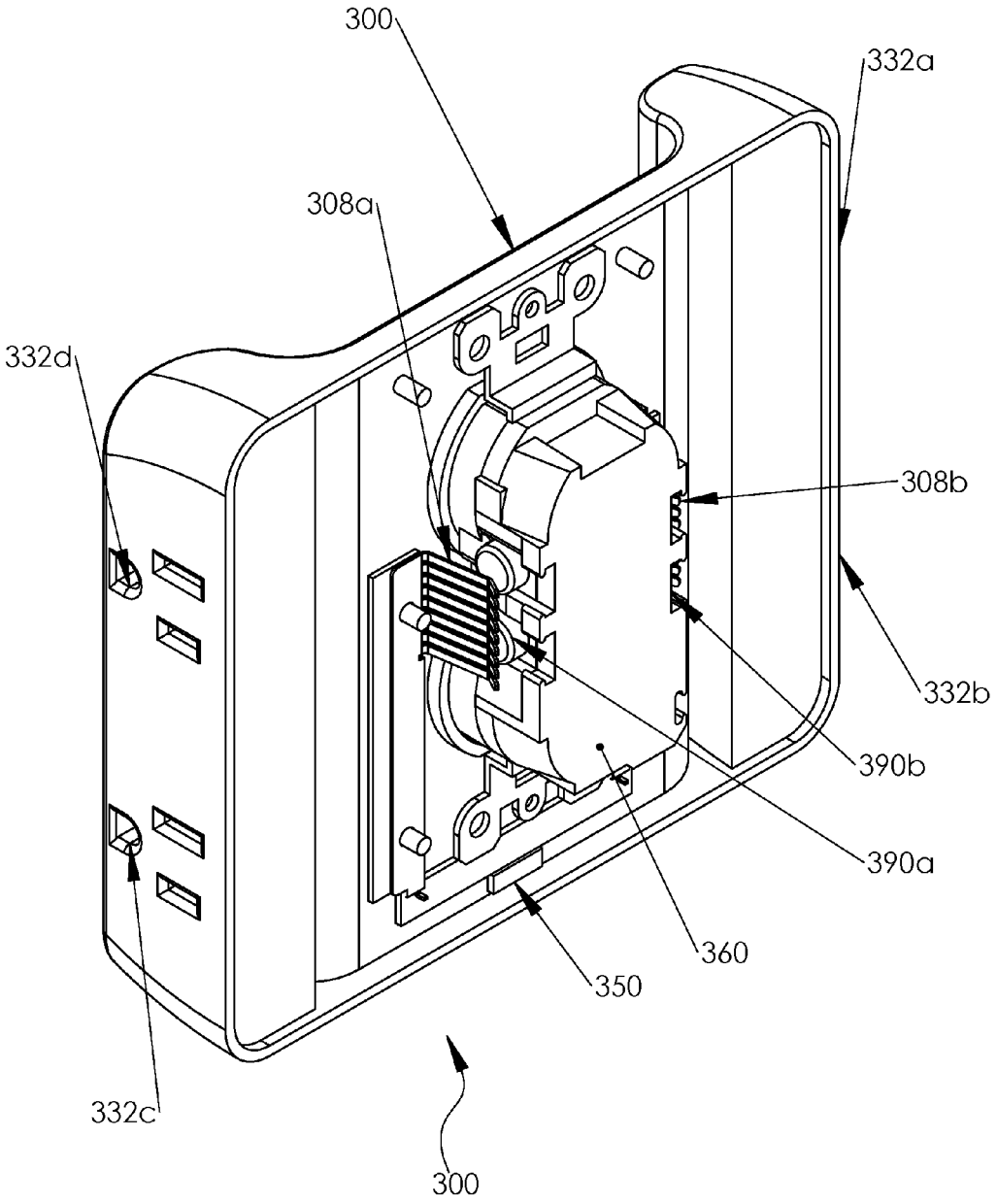

FIGS. 3A and 3B shows a side perspective view of the wall socket plate 300 being attached to an existing wall socket 360 in accordance with an embodiment of the present invention. In accordance with the embodiment shown, the metal tabs 308*a* and 308*b* are formed to surround the terminal screws 390*a* and 390*b*. A first plate receptacle 330*a* and a second plate receptacle 330*b* are fitted to surround a first wall receptacle 370*a* and a second wall receptacle 370*b* respectively, when the plate 300 is screwed into the wall socket 360, wherein receptacles 332*a*, 332*b*, 332*c* and 332*d* are also powered when the plate 300 is screwed into the existing wall socket 360. A hole for a screw 320 in the plate 300 is further provided to align the screw 325 in the wall socket 360 to affix the wall socket plate 300 to the wall socket 360. FIG. 3 also shows a light 350 for illuminating the wall socket plate 300, by converting high power to low power in the circuit board 335 to power the light 350.

In accordance with the embodiment shown in FIGS. 3A and 3B, three simple steps are provided for affixing the wall socket plate 300 to the wall socket 360. In a first step, a user unscrews an existing socket plate from a wall socket 360. In a second step, a user places the metal tabs 308*a* and 308*b* on the new socket plate to surround terminal screws 390*a*, 390*b* and their corresponding terminal screws on the other side of the wall socket 360, and in a final step a user places a screw 325 through a hole for a screw 320 in the wall socket 360 to attach the wall socket plate 300 to the wall socket 360. In accordance with the steps described in this embodiment, the light 350 is automatically lit when the wall socket plate 300 is screwed into place, and electric current is carried from the metal tabs 308*a* and 308*b* to power receptacles 332*a*, 332*b*, 332*c* and 332*d*. In this embodiment, the circuit board 335 is formed with a capacitor and resistors to lower the voltage from alternating current to direct current power, or to convert form high alternating current power of about 240 volts to 120 volts to low alternating current power, in a range of about 1 to 5 volts for powering a light emitting diode light. In other embodiments rectifiers are used convert high power current to low power current to illuminate a light in the wall socket plate 300.

There are many additional features and safety features that can be added to the wall socket plates with at least a third receptacle described in accordance with the embodiments of the present invention shown. Those features include but are not limited too, the addition of rubber or other non-conductive gripping pieces to the wall socket plate 400 or to the metal tabs 408*a* and 408*b* for ease of installation by a user, shortage safeguards in the circuit board to prevent any possibility of shock to a user, providing an on/off switch for ease of use by a user, along with many other features that a user may desire for safety or aesthetic purposes. In yet other embodiments, sensors may be embedded in the wall socket plate so that a light turns on and off when a signal is given, such as when a user walks by the sensors. In yet other embodiments, fragrance features, decorations, colored lights and/or decorated lights that release patterns, removable lights or light decoration patterns, designs, characters or the like, air fresheners, sound recordings, such as music for a child's room, may be further desired aspects of the present invention as features to add to wall socket plate 400 in accordance with the present invention. For instance, in one embodiment of the present invention an improved wall socket plate with a chamber containing a fragrance is further described, wherein the chamber containing the fragrance is connected to the one or more tabs in accordance with the present invention by a conductive material and wherein the chamber releases the liquid fragrance when the chamber is heated, thereby providing an air freshener to any room from a wall socket plate, without covering any of the existing wall socket receptacles.

In yet another embodiment of the present invention, a method is disclosed for easily powering and installing a wall socket light comprising the following steps: providing metal tabs on a socket plate for connecting to one or more socket terminal screws; connecting said metal tabs to said socket terminal screws; obtaining electric current from said one or more socket terminal screws through said metal tabs; transferring said electric current from said socket terminal screws to said third receptacle. In accordance with this method, a further step of providing a conductive material, wherein said conductive material transfers electric current from said terminal screws to said third receptacle is also provided.

In yet another method in accordance with the present invention the method for providing at least a third receptacle to a wall socket plate comprises the steps of: providing metal tabs on a socket plate for connecting to one or more socket terminals screws; connecting the metal tabs to said socket terminals screws; obtaining electric current from said one or more socket terminals screws through said metal tabs; and providing conductive material to transfer said electric current to said third receptacle, wherein the third receptacle is automatically powered when said plate is screwed into the wall socket.

In accordance with this method and as shown in FIG. 2, the step of powering four receptacles on the wall socket plate with the electric current through the conductive material is provided.

The installation requirements of the wall socket plate in accordance with the present invention are very simple and easy to use for a consumer. Nonetheless the applicant suggests the following simple procedure:

a) Unscrewing an existing socket plate, b) Aligning the metal tabs about the socket terminal screws, and c) Screwing the wall socket plate to the wall socket.

In accordance with the steps described, the direct contact the metal tabs with the socket terminal screws results in the electric current being transferred to a additional receptacles in the wall socket plate as shown and described herein. In yet other embodiments the electric current passing through the socket terminal screws may be conducted from other side tabs, metal plates or other variations of the embodiments described herein that would be obvious to one of ordinary skill in the art.

In addition, across the world there are many different types of sockets and socket plates available in the market. The embodiments of the present invention can be easily altered to accommodate any wall socket, including but not limited to type A, B, C, D, E, F, G, H, I, J, K, L, M electrical outlets, as each socket and receptacle varies in blade, pin, plug, power, and grounding mechanism, connecting and adding receptacles to the wall socket plate through power conducted through socket terminals is a unique finding in accordance with the present invention that can be easily implemented in any socket, socket box, or socket plate.

The applicant has given a non-limiting description of the devices, methods and systems of the present invention. Many changes may be made to this design without deviating from the spirit of this invention. Examples of such contemplated variations include, but are not limited to the following:

a) The shape and size, thickness and material used for the wall socket plate or parts thereof may be modified.

b) The color, aesthetics and materials may be enhanced or varied, including a feature package of designs or stickers developed to decorate the wall socket plates with at least a third receptacle described.

c) Additional complimentary and complementary functions and features may be added.

d) A more economical version and/or size of the wall socket plate may be adapted.

e) The wall socket plate may be operated manually with a switch or controlled or powered by a different energy, movement, light or other force.

f) The number and location of receptacles may be varied.

Other changes such as aesthetics and substitution of newer materials remain within the spirit of the invention disclosed herein.

While this invention has been described with reference to illustrative embodiments, the embodiments are not intended to be construed in a limiting sense. Various modifications and combinations of the illustrative embodiments as well as other embodiments of the invention will be apparent to a person of ordinary skill in the art upon reference to this description. It is therefore contemplated that the appended claim(s) cover any such modifications and embodiments that fall within the true scope of the invention.

The invention claimed is:

1. An improved wall socket plate comprising:

a plate formed to surround one or more receptacles on a wall socket;

one or more tabs connected to said plate, wherein said one or more tabs are designed to touch one or more socket terminal screws when said plate is screwed into a wall socket, wherein said one or more tabs conduct electric current from said one or more socket terminal screws; and, at least a third receptacle, wherein said third receptacle is connected to said one or more tabs by a conductive material and wherein said third receptacle is automatically powered when said plate is screwed into a wall socket.

2. The improved wall socket plate in accordance with claim 1 wherein said one or more tabs are metal tabs.

3. The improved wall socket plate in accordance with claim 1 further including a circuit board in said wall socket plate.

4. The improved wall socket plate in accordance with claim 3 further including a light in said plate, wherein said light is connected to said one or more tabs by a conductive material and wherein said light is automatically turned on when said plate is screwed into a wall socket.

5. A method for powering at least a third receptacle on a socket plate, comprising:

providing metal tabs on a socket plate for connecting to one or more socket terminal screws;

connecting said metal tabs to said socket terminal screws;

obtaining electric current from said one or more socket terminal screws through said metal tabs;

transferring said electric current from said socket terminal screws said third receptacle.

6. The method in accordance with claim 5 further comprising the step of providing a conductive material, wherein said conductive material transfers electric current from said terminal screws to said third receptacle.

7. An improved wall socket plate comprising:

a plate formed to surround one or more receptacles on a wall socket;

one or more tabs connected to said plate, wherein said one or more tabs are designed to touch one or more socket terminal screws when said plate is screwed into a wall socket, wherein said one or more tabs conduct electric current from said one or more socket terminal screws;

a light in said plate, wherein said light is connected to said one or more tabs by a first conductive material and wherein said light is automatically turned on when said plate is screwed into a wall socket;

a capacitor, wherein said capacitor connected to said conductive material; and, a resistor, wherein said capacitor and said resistor reduces electric current from said conductive material from high power to low power to illuminate said light; and, at least a third receptacle, wherein said third receptacle is connected to said one or more tabs by a second conductive material and wherein said third receptacle is automatically powered when said plate is screwed into a wall socket.

8. A method for providing at least a third receptacle to a wall socket plate comprising:

providing metal tabs on a socket plate for connecting to one or more socket terminals screws;

connecting said metal tabs to said socket terminals screws;

obtaining electric current from said one or more socket terminals screws through said metal tabs:

providing conductive material to transfer said electric current to said third receptacle, wherein said third receptacle is automatically powered when said plate is screwed into the wall socket.

9. The method in accordance with claim 8 including the step of powering four receptacles on said wall socket plate with said electric current through said conductive material.

* * * * *